US008558780B2

(12) United States Patent
Lee et al.

(10) Patent No.: US 8,558,780 B2
(45) Date of Patent: Oct. 15, 2013

(54) DISPLAY APPARATUS AND METHOD THEREOF

(75) Inventors: Young-A Lee, Cheonan-si (KR); Yong-Hyun Hwang, Cheonan-si (KR); Kwang-Soo Lee, Yongin-si (KR); Dong-Gyu Lee, Daegu (KR); Doo-Won Lee, Seoul (KR); Jong-Young Yun, Seoul (KR); Neung-Beom Lee, Asan-si (KR)

(73) Assignee: Samsung Display Co., Ltd. (KR)

( * ) Notice: Subject to any disclaimer, the term of this patent is extended or adjusted under 35 U.S.C. 154(b) by 1391 days.

(21) Appl. No.: 12/043,396

(22) Filed: Mar. 6, 2008

(65) Prior Publication Data

US 2008/0231591 A1 Sep. 25, 2008

(30) Foreign Application Priority Data

Mar. 21, 2007 (KR) ..... 10-2007-0027418

(51) Int. Cl.
*G09G 3/36* (2006.01)

(52) U.S. Cl.
USPC ..... 345/102; 345/87

(58) Field of Classification Search
USPC ..... 345/87–111; 349/61–69
See application file for complete search history.

(56) References Cited

U.S. PATENT DOCUMENTS

| | | | | |
|---|---|---|---|---|
| 6,871,975 | B2 * | 3/2005 | Chuang | 362/27 |
| 2004/0130884 | A1 * | 7/2004 | Yoo et al. | 362/31 |
| 2004/0246226 | A1 * | 12/2004 | Moon | 345/102 |
| 2007/0139606 | A1 * | 6/2007 | Kim et al. | 349/158 |

FOREIGN PATENT DOCUMENTS

| | | | |
|---|---|---|---|
| KR | 1998025139 | U | 7/1998 |
| KR | 20-0282031 | | 7/2002 |
| KR | 1020050043715 | A | 5/2005 |
| KR | 1020060001570 | A | 1/2006 |
| KR | 1020060096970 | A | 9/2006 |

* cited by examiner

*Primary Examiner* — Srilakshmi K Kumar
(74) *Attorney, Agent, or Firm* — Cantor Colburn LLP

(57) ABSTRACT

A display apparatus includes a backlight assembly, a first display panel assembly and a second display panel assembly. The backlight assembly includes a plurality of lamps disposed substantially parallel with each other. The backlight assembly emits first light through a first face and second light through a second face. The first display panel assembly is disposed adjacent to the first face to receive the first light. The second display panel assembly is disposed adjacent to the second face to receive the second light. The backlight assembly may further include a driving inverter electrically connected to first and second ends of the lamps to provide the lamps with driving voltages. Therefore, the backlight assembly applies light to the first and second display panel assemblies to reduce the number of backlight assemblies. Therefore, costs for manufacturing a display apparatus may be reduced.

13 Claims, 10 Drawing Sheets

DISPLAY APPARATUS AND METHOD THEREOF

This application claims priority to Korean Patent Application No. 2007-27418, filed on Mar. 21, 2007 and all the benefits accruing therefrom under 35 U.S.C. §119, and the contents of which in its entirety are herein incorporated by reference.

BACKGROUND OF THE INVENTION

1. Field of the Invention

The present invention relates to a display apparatus and method thereof. More particularly, the present invention relates to a display apparatus capable of reducing manufacturing costs thereof, and a method of reducing manufacturing costs of a display apparatus.

2. Description of the Related Art

Nowadays, a liquid crystal display ("LCD") apparatus is frequently employed as an outdoor display apparatus in an airport, a bus terminal, etc., for reducing power consumption and volume. The LCD apparatus, typically, includes a backlight assembly generating light and an LCD panel displaying an image by using the light generated by the backlight assembly.

For an outdoor display apparatus, for example, an advertisement, it is preferable to display an image in two directions or three directions. That is, it is preferable for an outdoor display apparatus to employ two or three LCD panels.

However, when an outdoor display apparatus employs two or three LCD panels, costs for manufacturing the outdoor display apparatus increase.

BRIEF SUMMARY OF THE INVENTION

The present invention provides a display apparatus capable of reducing manufacturing costs thereof.

The present invention also provides a method of reducing manufacturing costs of a display apparatus.

In an exemplary embodiment of a display apparatus according to the present invention, the display apparatus includes a backlight assembly, a first display panel assembly and a second display panel assembly.

The backlight assembly includes first light sources emitting first light through a first face of the backlight assembly and second light sources emitting second light through a second face of the backlight assembly. The first display panel assembly is disposed adjacent to the first face to receive the first light. The second display panel assembly is disposed adjacent to the second face to receive the second light. The first light sources are disposed adjacent to the first display panel assembly, and the second light sources are disposed adjacent to the second display panel assembly.

The first light sources may include a plurality of first lamps arranged substantially parallel with each other, and the second light source may include a plurality of second lamps arranged substantially parallel with each other. The backlight assembly may further include a driving inverter electrically connected to first and second ends of the lamps to provide the lamps with driving voltages.

The first and second lamps may be alternately disposed to form a zigzag shape.

The first and second lamps may have a cylindrical shape along a first direction, and are arranged substantially parallel with each other along a second direction that is substantially perpendicular to the first direction. The driving inverter may include a first inverter and a second inverter. The first inverter may be electrically connected to first ends of the first and second lamps, and the second inverter may be electrically connected to second ends of the first and second lamps. The first inverter may be disposed at a first side of the backlight assembly and the second inverter may be disposed at a second side of the backlight assembly, the second side being opposite to the first side along the first direction.

In another exemplary embodiment of a display apparatus according to the present invention, the display apparatus includes a backlight assembly, a first display panel assembly, a second display panel assembly and a third display panel assembly.

The backlight assembly has a triangular shape in a plan view to have a first face, a second face and a third face. The backlight assembly includes a plurality of lamps disposed substantially parallel with each other with respect to each face to emit first light through the first face, second light through the second face and third light through the third face. The first display panel assembly is disposed adjacent to the first face to receive the first light. The second display panel assembly is disposed adjacent to the second face to receive the second light. The third display panel assembly is disposed adjacent to the third face to receive the third light. The backlight assembly may further include a driving inverter electrically connected to first and second ends of the lamps to provide the lamps with driving voltages.

The lamps may include first lamps, second lamps and third lamps. The first lamps may be disposed adjacent to the first display panel assembly and substantially parallel with each other. The second lamps may be disposed adjacent to the second display panel assembly and substantially parallel with each other. The third lamps may be disposed adjacent to the third display panel assembly and substantially parallel with each other. For example, the first, second and third lamps may be disposed deviated from each other.

The first, second and third lamps may have a cylindrical shape along a respective first direction, and are arranged substantially parallel with each other along a second direction that is substantially perpendicular to the first direction. The driving inverter may include a first inverter, a second inverter and a third inverter. The first inverter may be electrically connected to first ends of the first lamps and first ends of the second lamps. The second inverter may be electrically connected to second ends of the second lamps and first ends of the third lamps. The third inverter may be electrically connected to the second ends of the third lamps and second ends of the first lamps.

A method of reducing manufacturing costs of a display apparatus including a plurality of separate display panel assemblies, may include arranging a single backlight assembly having a first face adjacent to a first display panel assembly and a second face adjacent to a second display panel assembly, and including a plurality of lamps to emit first light through the first face and second light through the second face.

According to the present invention, a backlight assembly applies light to first and second display panel assemblies or first, second and third display panel assemblies to reduce the number of backlight assemblies. Therefore, costs for manufacturing a display apparatus may be reduced.

BRIEF DESCRIPTION OF THE DRAWINGS

The above and other features and advantages of the present invention will become more apparent by describing in detail exemplary embodiments thereof with reference to the accompanying drawings, in which.

DETAILED DESCRIPTION OF THE INVENTION

Figure 1:
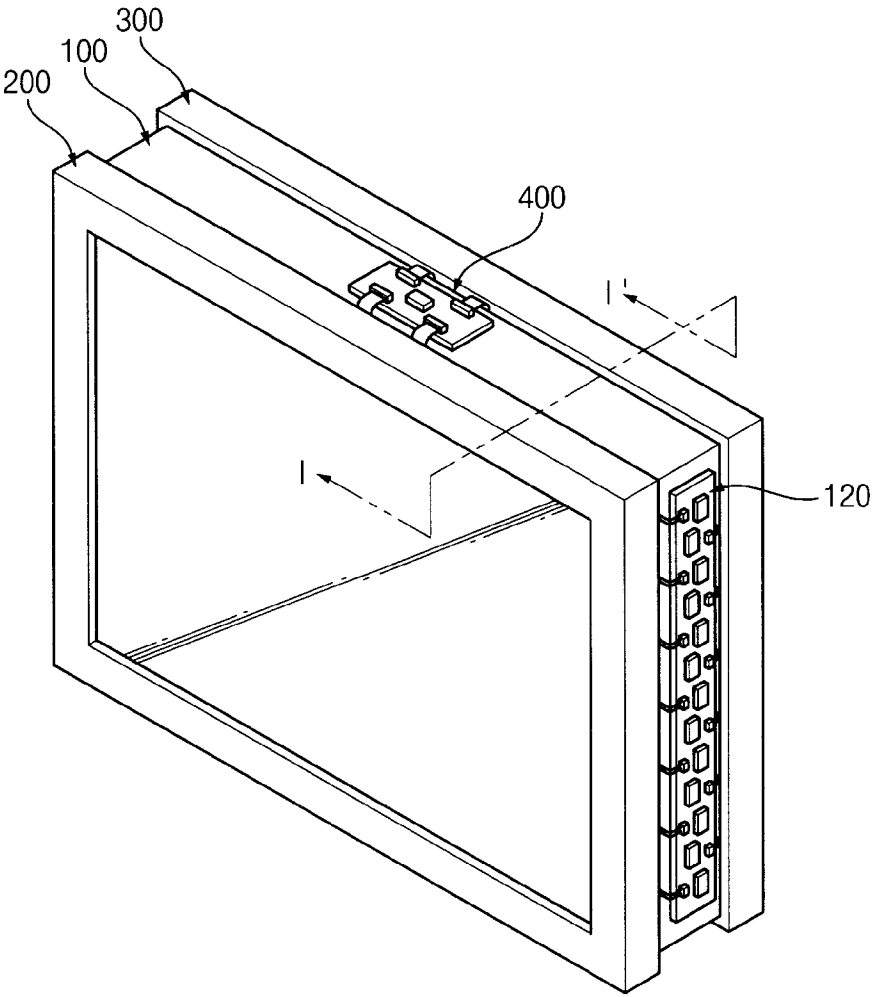
FIG. 1 is a perspective view illustrating an exemplary display apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Embodiment 1

FIG. 1 is a perspective view illustrating an exemplary display apparatus according to an exemplary embodiment of the present invention.

Referring to FIG. 1, a display apparatus according to an exemplary embodiment of the present invention is shown. In an exemplary embodiment, the display apparatus may be an outdoor display apparatus usable in an outdoor environment, such as an airport, bus terminal, etc. However, the display apparatus may also be employed in any number of indoor environments, such as an auditorium, indoor sports arena, exhibit halls, etc. The display apparatus includes a backlight assembly 100, a first display panel assembly 200, a second display panel assembly 300 and a control board 400.

Figure 2:
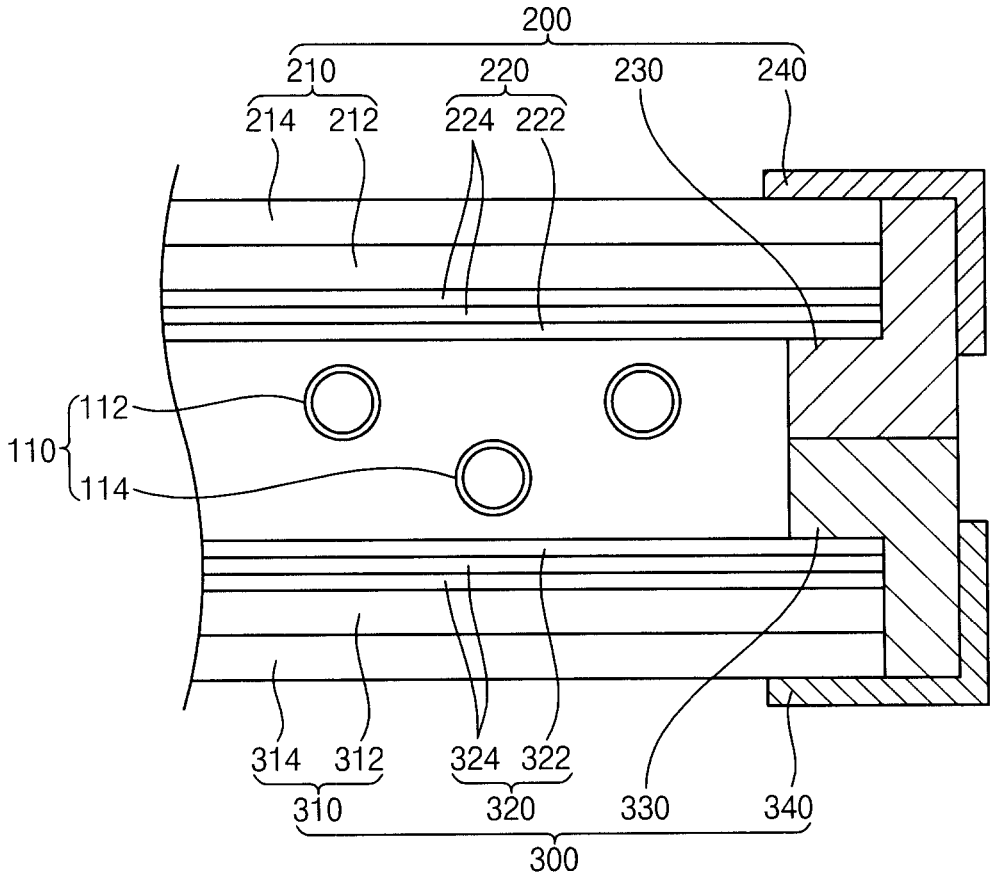
FIG. 2 is a cross-sectional view taken along line I-I' in FIG. 1.
Figure 3:
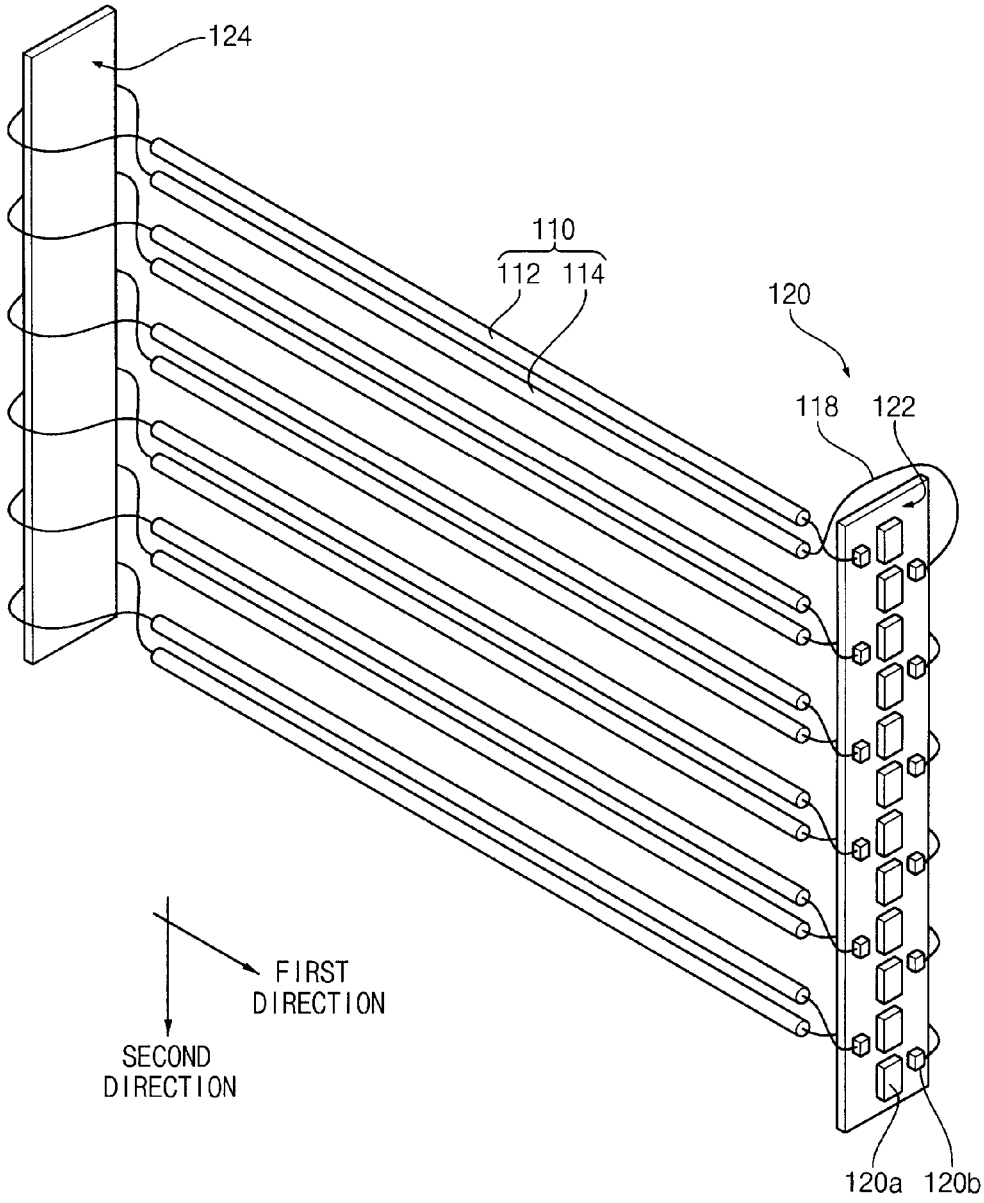
FIG. 3 is a perspective view illustrating exemplary electrical connections between lamps and inverters in FIG. 1.
Figure 4:
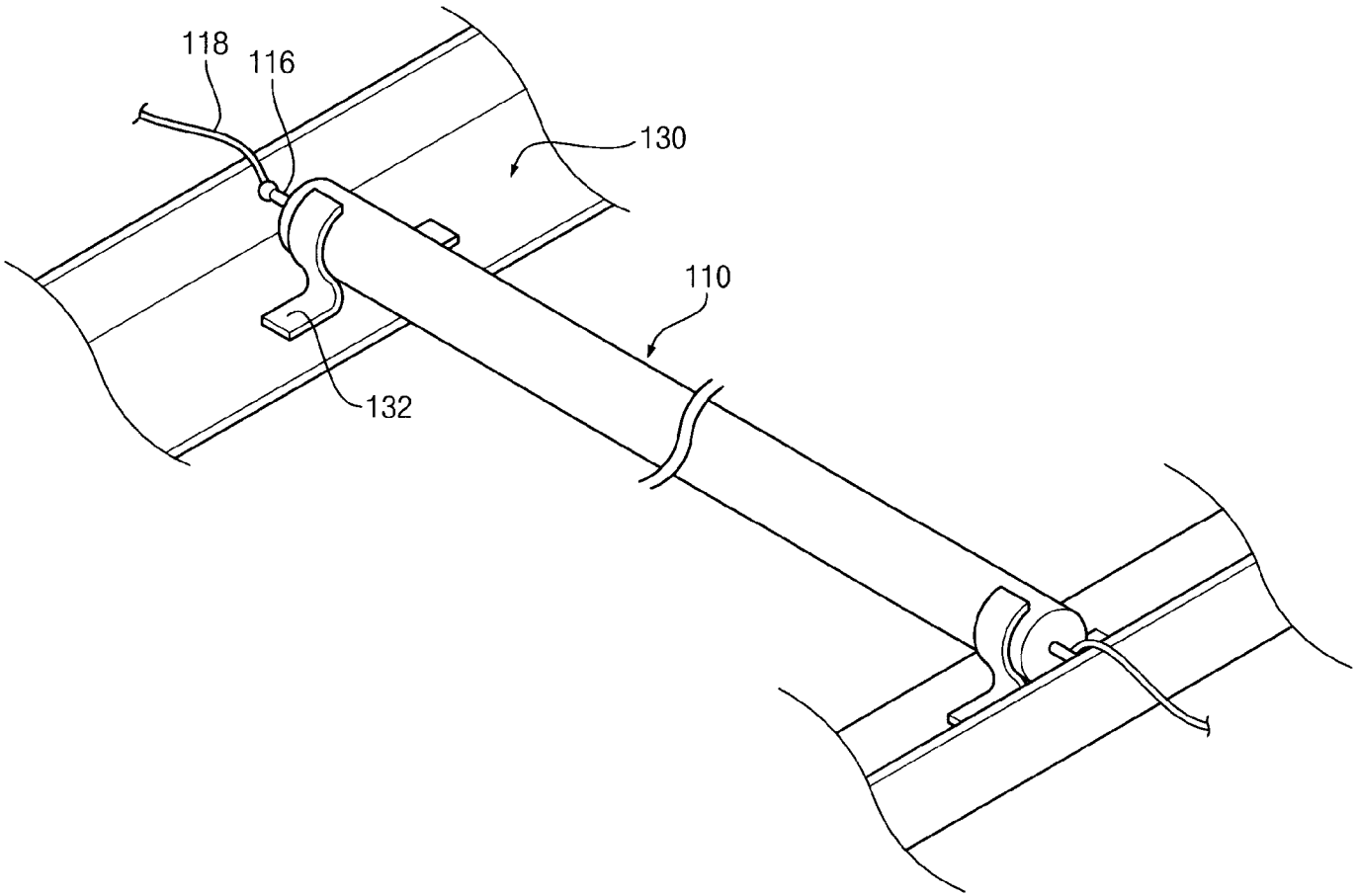
FIG. 4 is a perspective view illustrating an exemplary connection between a lamp and an exemplary lamp fixing unit in FIG. 1.

The backlight assembly 100 emits first light through a first face of the backlight assembly 100 and second light through a second face of the backlight assembly 100 that is opposite to the first face. The backlight assembly 100 includes a plurality of lamps 110 (as shown in FIGS. 2 to 4) and a driving inverter 120. The lamps 110 generate light, and the driving inverter 120 applies driving voltages to the lamps 110. The backlight assembly 100 may include two pairs of opposing side portions disposed between the first and second faces. The driving inverter 120 is disposed at a side portion or side portions of the backlight assembly 100.

The first display panel assembly 200 is disposed at the first face of the backlight assembly 100. The first display panel assembly 200 displays an image by using the first light generated by the backlight assembly 100.

The second display panel assembly 300 is disposed at the second face of the backlight assembly 100. The second display panel assembly 300 displays an image by using the second light generated by the backlight assembly 100.

The control board 400 provides the first and second display panel assemblies 200 and 300 with a driving signal to control the first and second display panel assemblies 200 and 300. The control board 400 is disposed on a side of which the normal axis is substantially perpendicular to a longitudinal axis of lamps 110. For example, the control board 400 is disposed on an upper side portion of the backlight assembly 100.

FIG. 2 is a cross-sectional view taken along line I-I' in FIG. 1.

Referring to FIG. 2, the first display panel assembly 200 includes, for example, a first display panel 210, first optical sheets 220, a first mold frame 230 and a first top chassis 240.

The first display panel 210 is disposed to face the first face of the backlight assembly 100, so that the first display panel 210 displays an image by using the first light emitted through the first face of the backlight assembly 100. The first display panel 210 includes a first array substrate 212, a first opposite substrate 214 and a first liquid crystal layer (not shown). The first array substrate 212 and the first opposite substrate 214 face each other. The first liquid crystal layer is disposed between the first array substrate 212 and the first opposite substrate 214.

The first optical sheets 220 are disposed between the lamps 110 of the backlight assembly 100 and the first display panel 210 to enhance optical characteristics of the first light generated by the lamps 110. The first optical sheets 220 include, for example, a first diffusion sheet 222 and at least one first prism sheet 224.

The first mold frame 230 receives the first display panel 210 and the first optical sheets 220. In detail, the first mold frame 230 surrounds and supports edge portions of the first display panel 210 and the first optical sheets 220.

The first top chassis 240 fastens the first display panel 210 to the first mold frame 230. In detail, the first top chassis 240 is combined with the first mold frame 230 while compressing edge portions of the first display panel 210 to the first mold frame 230. As a result, the first display panel 210 and the first optical sheets 220 are fastened to the first mold frame 230.

The second display panel assembly 300 includes, for example, a second display panel 310, second optical sheets 320, a second mold frame 330 and a second top chassis 340.

The second display panel 310 is disposed to face the second face of the backlight assembly 100, so that the second display panel 310 displays an image by using the second light emitted through the second face of the backlight assembly 100. The second display panel 310 includes a second array substrate 312, a second opposite substrate 314 and a second liquid crystal layer (not shown). The second array substrate 312 and the second opposite substrate 314 face each other. The second liquid crystal layer is disposed between the second array substrate 312 and the second opposite substrate 314.

The second optical sheets 320 are disposed between the lamps 110 and the second display panel 310 to enhance optical characteristics of the second light generated by the lamps 110. The second optical sheets 320 include, for example, a second diffusion sheet 322 and at least one second prism sheet 324.

The second mold frame 330 receives the second display panel 310 and the second optical sheets 320. In detail, the second mold frame 330 surrounds and supports edge portions of the second display panel 310 and the second optical sheets 320.

The second top chassis 340 fastens the second display panel 310 to the second mold frame 330. In detail, the second top chassis 340 is combined with the second mold frame 330 while compressing edge portions of the second display panel 310 to the second mold frame 330. As a result, the second display panel 310 and the second optical sheets 320 are fastened to the second mold frame 330.

FIG. 3 is a perspective view illustrating exemplary electrical connections between lamps and inverters in FIG. 1, and FIG. 4 is a perspective view illustrating an exemplary connection between a lamp and a lamp fixing unit in FIG. 1.

Referring to FIGS. 1 to 4 while focusing on FIG. 3, the backlight assembly 100 according to the present exemplary embodiment includes the lamps 110, the driving inverter 120 and a lamp fixing unit 130.

The lamps 110 have, for example, a cylindrical shape having an axis that is substantially parallel with a first direction. The lamps 110 are arranged with respect to each other in a second direction that is substantially perpendicular to the first direction such that the lamps 110 are substantially parallel with each other. The lamps 110 include first lamps 112 and second lamps 114. The first lamps 112 are disposed adjacent to the first display panel assembly 200. The second lamps 114 are disposed adjacent to the second display panel assembly 300.

In an alternative exemplary embodiment, the lamps 110 may have a U-shape instead of the cylindrical shape, and the lamps 110 having the U-shape may be disposed substantially parallel with each other.

In an exemplary embodiment, each of the second lamps 114 is disposed between the first lamps 112, and vice versa. Therefore, the first and second lamps 112 and 114 are alternately disposed to form a zigzag shape.

The driving inverter 120 is electrically connected to both ends of each of the lamps 110 to provide the lamps 110 with driving voltages. For example, the driving inverter 120 includes a first inverter 122 and a second inverter 124.

The first inverter 122 is electrically connected to first ends of the first and second lamps 112 and 114, and the second inverter 124 is electrically connected to second ends of the first and second lamps 112 and 114.

Each of the first and second inverters 122 and 124 includes, for example, driving transformers **120*a* and connectors 120*b*. The driving transformers 120*a* generate the driving voltages and apply the driving voltage to the connectors 120*b*. The connectors 120*b* are disposed on a base substrate such that the connectors 120*b* correspond to the first and second lamps 112 and 114. The connectors 120*b* are electrically connected to lead lines 116 of the first and second lamps 112 and 114 through connecting wirings 118 to apply the driving voltage to the first and second lamps 112 and 114. In an exemplary embodiment, the driving transformers 120*a* may be arranged with respect to each other along a central portion of the base substrate substantially parallel to the second direction, and half of the connectors 120***b* for connecting to the first lamps 112 may be disposed on one side of the driving transformers 120*a*, and the other half of the connectors 120*b* for connecting to the second lamps 114 may be disposed on the other side of the driving transformers 120*a*.

The first inverter 122 is disposed at a first side of the side portions of the backlight assembly 100, and the second inverter 124 is disposed at a second side of the side portions of the backlight assembly 100 that is opposite to the first side along the first direction. The control board 400 is disposed at a third side corresponding to the upper side portion of the backlight assembly 100.

The lamp fixing unit 130 is disposed at end portions of the lamps 110 to fix the lamps 110 within the backlight assembly 100. The lamp fixing unit 130 may include fixing clips 132 for fixing the end portions of the lamps 110.

Figure 5:
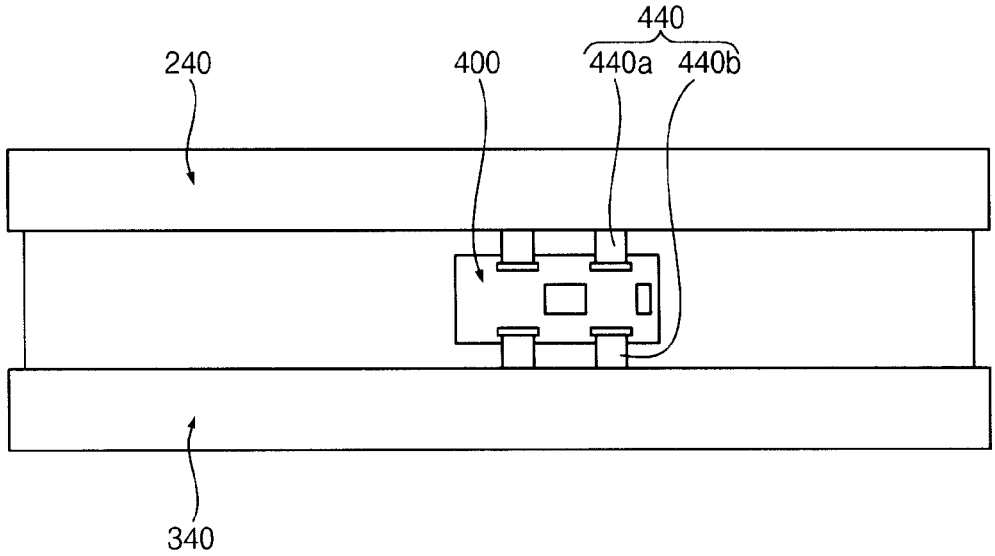
FIG. 5 is a plan view illustrating the exemplary display apparatus in FIG. 1.

FIG. 5 is a plan view illustrating the exemplary display apparatus in FIG. 1.

Referring to FIGS. 1 and 5, the control board 400 is disposed on the upper side portion of the backlight assembly 100, such as the third side of the backlight assembly, preferably between the first top chassis 240 of the first display panel assembly 200 and the second top chassis 340 of the second display panel assembly 300.

Likewise, the driving inverter 120 is disposed at a side portion of the backlight assembly 100, such as the first and second sides of the backlight assembly 100, preferably between the first top chassis 240 of the first display panel assembly 200 and the second top chassis 340 of the second display panel assembly 300.

Figure 6:
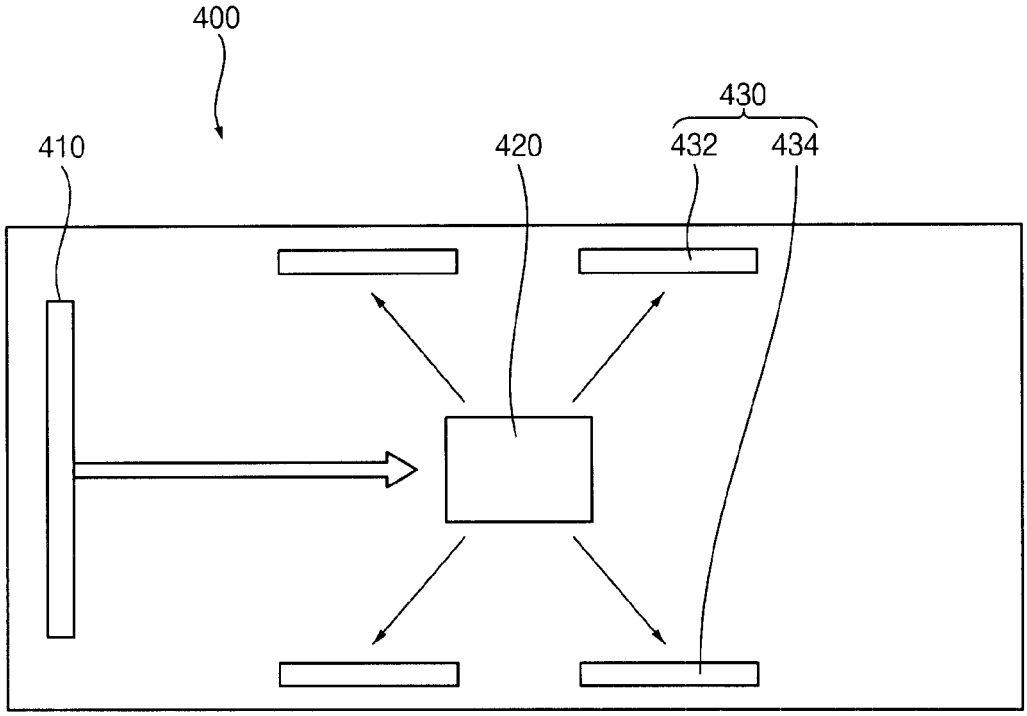
FIG. 6 is a plan view illustrating the exemplary control board in FIG. 1.

FIG. 6 is a plan view illustrating the exemplary control board in FIG. 1.

Referring to FIGS. 5 and 6, the control board 400 includes an input connector 410, a timing controller 420 and an output connector 430.

The input connector 410 receives an image signal from an external graphic controller (not shown).

The timing controller 420 is electrically connected to the input connector 410 to receive the image signal, and generates driving signals in response to the image signal.

The output connector 430 is electrically connected to the timing controller 420 to receive the driving signals. For example, the output connector 430 is electrically connected to the first and second display panels 210 and 310 through a flexible printed circuit board ("FPCB") 440 to transfer the driving signals to the first and second display panels 210 and 310.

In detail, the output connector 430 includes a first output section 432 electrically connected to the first display panel 210 through a first FPCB 440*a*, and a second output section 434 electrically connected to the second display panel 310 through a second FPCB 440*b*. As illustrated, a plurality of first FPCBs 440*a* may connect to a plurality of first output sections 432, and a plurality of second FPCBs 440*b* may connect to a plurality of second output sections 434.

As a result, the display apparatus including the control board 400 in FIG. 6 displays an image in two directions through the first and second display panels 210 and 310.

Figure 7:
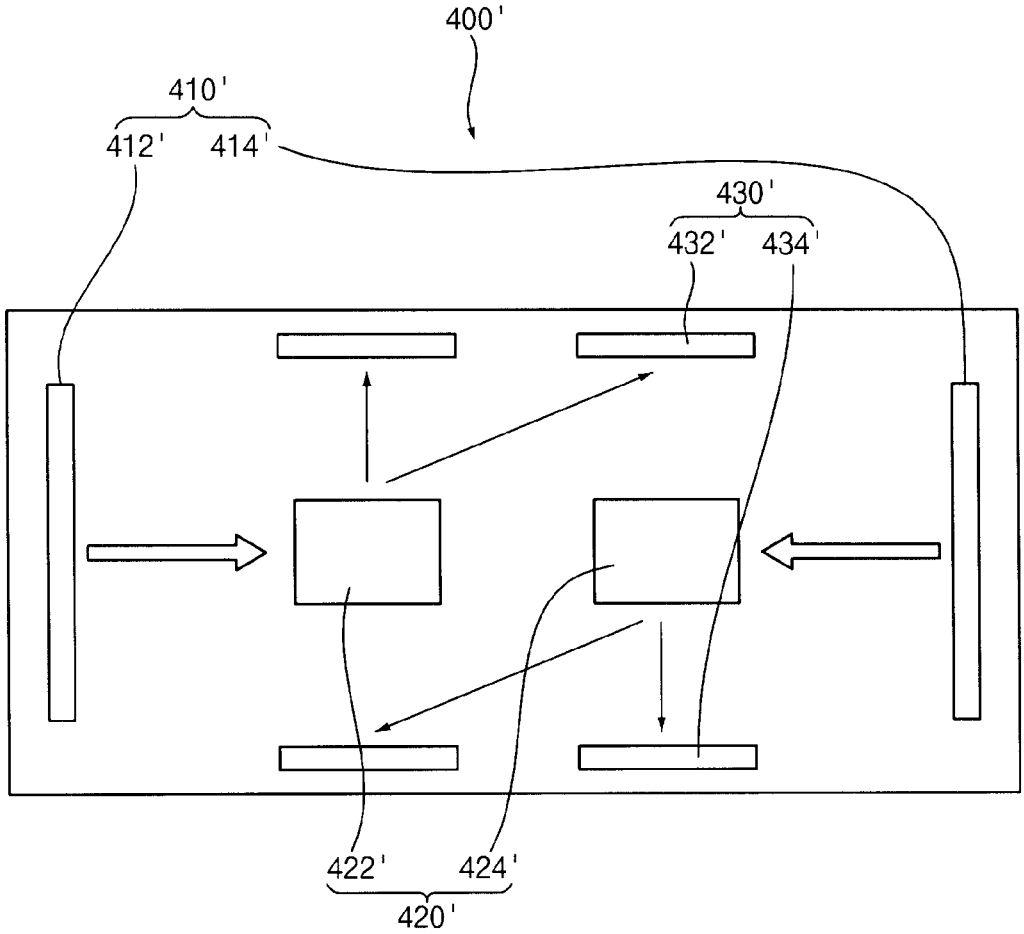
FIG. 7 is a plan view illustrating an exemplary control board different from the exemplary control board in FIG. 6.

FIG. 7 is a plan view illustrating an exemplary control board different from the exemplary control board in FIG. 6.

Referring to FIG. 7, the control board 400' may have a different structure from the control board 400 in FIG. 6 for displaying different images through the first and second display panels 210 and 310.

In detail, the control board 400' includes an input connector 410', a timing controller 420' and an output connector 430'.

The input connector 410' includes a first input section 412' receiving a first image signal from a first external device (not shown), and a second input section 414' receiving a second image signal from a second external device (not shown).

The timing controller 420' includes a first control section 422' generating a first driving signal in response to the first image signal, and a second control section 424' generating a second driving signal in response to the second image signal.

The output connector 430' includes a first output section 432' outputting the first driving signal to the first display panel 210, and a second output section 434' outputting the second driving signal to the second display panel 310.

As described above, the control board 400' according to the present exemplary embodiment separately controls the first and second display panels 210 and 310 through the first and second control sections 422' and 424'. Therefore, the display apparatus employing the control board 400' may simultaneously display different images through the first and second display panels 210 and 310.

According to the present invention described above, the backlight assembly 100 provides both of the first and second display panels 210 and 310 with light. As a result, costs for manufacturing the backlight assembly 100 may be reduced.

In detail, according to the conventional outdoor display apparatus, two backlight assemblies respectively provide the first and second display panels with light. However, according to the present invention, the conventional two backlight assemblies are combined into one backlight assembly to reduce the costs for manufacturing the display apparatus.

Embodiment 2

Figure 8:
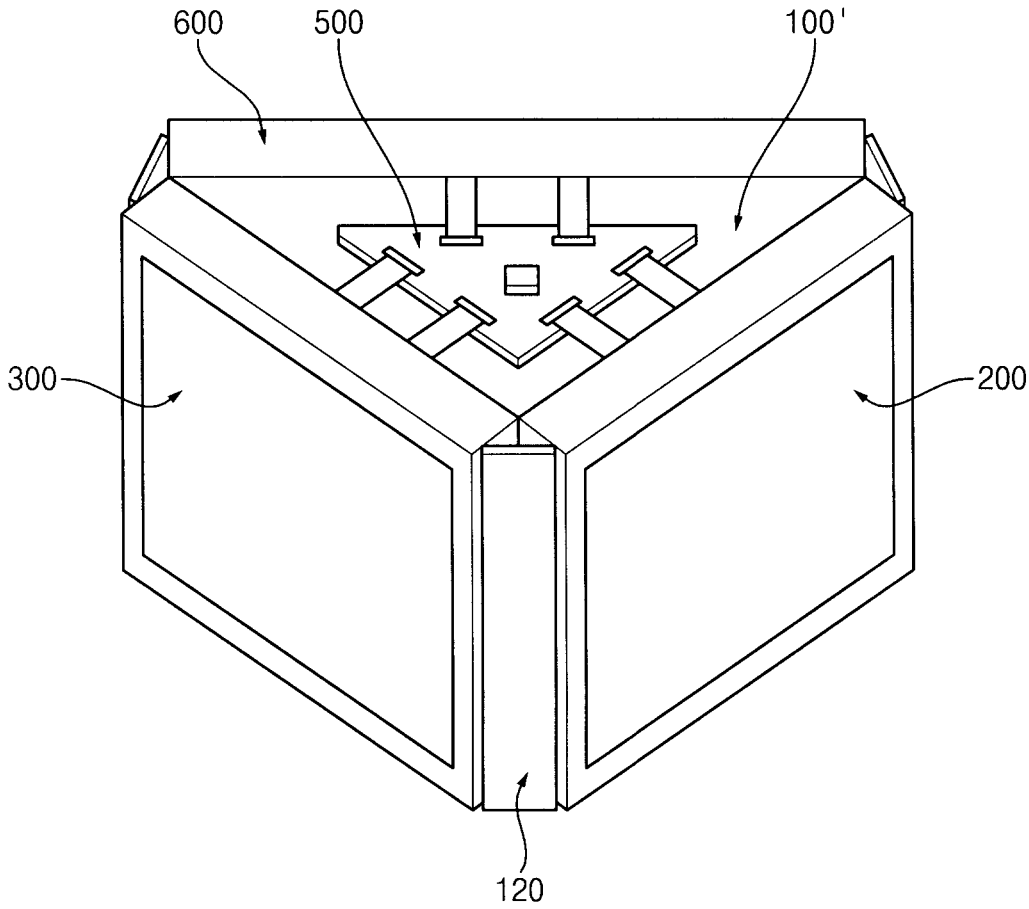
FIG. 8 is a perspective view illustrating an exemplary display apparatus according to another exemplary embodiment of the present invention.

FIG. 8 is a perspective view illustrating an exemplary display apparatus according to another exemplary embodiment of the present invention.

Referring to FIG. 8, a display apparatus according to the present exemplary embodiment of the present invention includes a backlight assembly 100', a first display panel assembly 200, a second display panel assembly 300, a third display panel assembly 600 and a control board 500.

Figure 9:
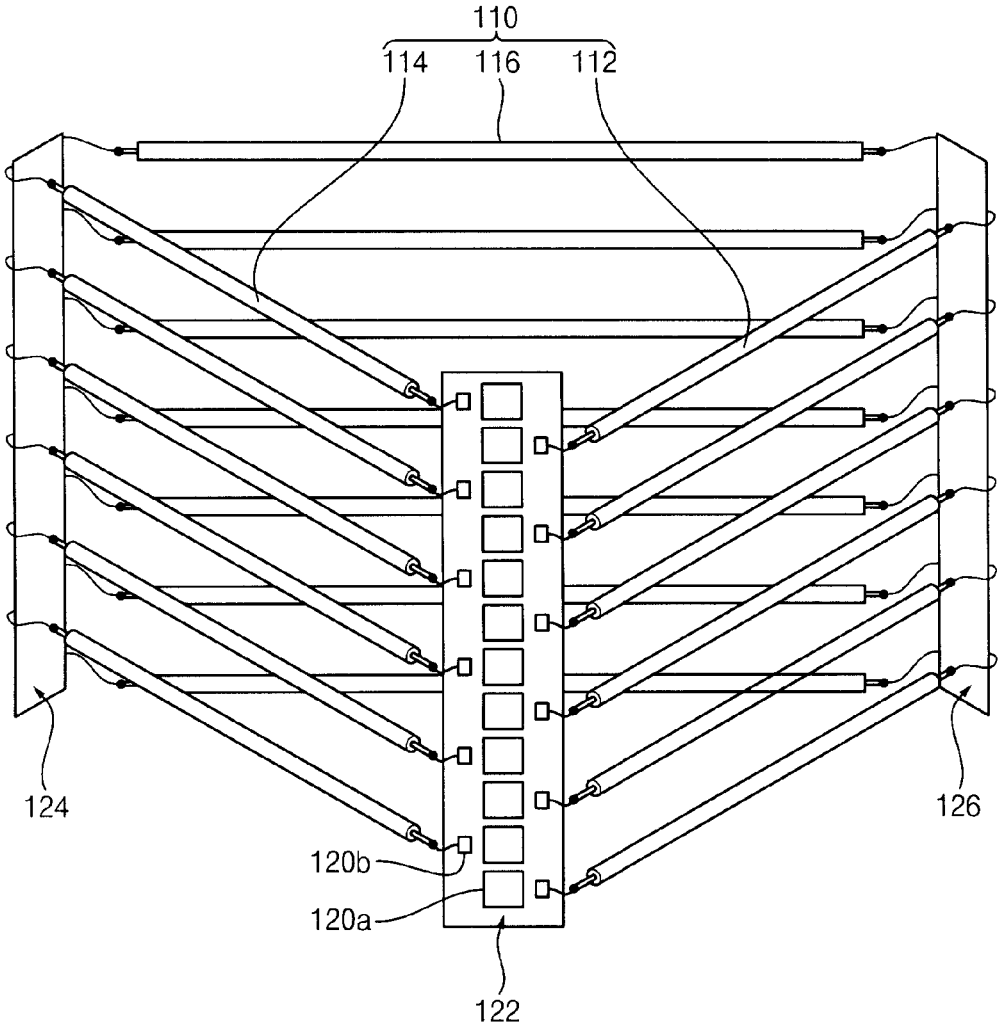
FIG. 9 is a perspective view illustrating exemplary electrical connections between lamps and inverters in FIG. 8.

The backlight assembly 100' has a triangular shape when viewed on a plane to have a first face, a second face and a third face. Preferably, the backlight assembly 100' has an equilateral triangular shape. The backlight assembly 100' emits first light through the first face, second light through the second face, and third light through the third face. The backlight assembly 100' includes a plurality of lamps 110 (as shown in FIG. 9) and a driving inverter 120. The lamps 110 generate light, and the driving inverter 120 applies driving voltages to the lamps 110. The driving inverter 120 is disposed at a portion where two of the first, second and third faces of the backlight assembly 100' meet with each other.

The first display panel assembly 200 is disposed at the first face of the backlight assembly 100'. The first display panel assembly 200 displays an image by using the first light generated by the backlight assembly 100'.

The second display panel assembly 300 is disposed at the second face of the backlight assembly 100'. The second display panel assembly 300 displays an image by using the second light generated by the backlight assembly 100'.

The third display panel assembly 600 is disposed at the third face of the backlight assembly 100'. The third display panel assembly 600 displays an image by using the third light generated by the backlight assembly 100'.

Each of the first, second and third display panel assemblies 200, 300, and 600 has substantially the same structure as described with reference to FIG. 2. Thus, any further explanation will be omitted.

The control board 500 provides the first, second and third display panel assemblies 200, 300 and 600 with a driving signal to control the first, second and third display panel assemblies 200, 300 and 600. For example, the control board 500 is disposed on an upper portion of the backlight assembly 100'.

FIG. 9 is a perspective view illustrating exemplary electrical connections between lamps and inverters in FIG. 8.

Referring to FIGS. 8 and 9, the backlight assembly 100' according to the present exemplary embodiment includes the lamps 110 and the driving inverter 120. The backlight assembly 100' may further include a lamp fixing unit (not shown).

The lamps 110 have, for example, a cylindrical shape having an axis that is substantially parallel with a first direction of each face of the backlight assembly 100'. The lamps 110 are arranged with respect to each other in a second direction of each face of the backlight assembly 100' that is substantially perpendicular to the first direction of each face of the backlight assembly 100' such that the lamps 110 are substantially parallel with each other. The lamps 110 are disposed corresponding to the first, second and third sides of the backlight assembly 100'.

In detail, the lamps 110 include first lamps 112, second lamps 114 and third lamps 116. The first lamps 112 are disposed adjacent to the first display panel assembly 200. The second lamps 114 are disposed adjacent to the second display panel assembly 300. The third lamps 116 are disposed adjacent to the third display panel assembly 600. For example, one of the first, second and third lamps 112, 114 and 116 may be disposed on the same virtual plane. Alternatively, the first, second and third lamps 112, 114 and 116 may be alternately disposed.

The lamps 110 may have a U-shape instead of the cylindrical shape, and the lamps 110 having the U-shape may be disposed substantially parallel with each other.

The driving inverter 120 is electrically connected to both ends of each of the lamps 110 to provide the lamps 110 with driving voltages. For example, the driving inverter 120 includes a first inverter 122, a second inverter 124 and a third inverter 126.

The first inverter 122 is electrically connected to first ends of the first and second lamps 112 and 114. The first ends of the first lamps 112 may be connected to a first side of the first inverter 122, and the first ends of the second lamps 114 may be connected to a second side of the first inverter 122. The second inverter 124 is electrically connected to second ends of the second lamps 114 and first ends of the third lamps 116. The second ends of the second lamps 114 may be connected to a first side of the second inverter 124, and the first ends of the third lamps 116 may be connected to a second side of the second inverter 124. The third inverter 126 is electrically connected to second ends of the third and first lamps 116 and 112. The second ends of the third lamps 116 may be connected to a first side of the third inverter 126, and the second ends of the first lamps 112 may be connected to a second side of the third inverter 126.

The first inverter 122 is disposed at a first corner where the first and second faces of the backlight assembly 100' meet each other. The second inverter 124 is disposed at a second corner where the second and third faces of the backlight assembly 100' meet each other. The third inverter 126 is disposed at a third corner where the third and first faces of the backlight assembly 100' meet each other.

Each of the first, second and third inverters 122, 124 and 126 includes, for example, driving transformers 120*a* and connectors 120*b*. The driving transformers 120*a* generate the driving voltages and apply the driving voltage to the connectors 120*b*. The connectors 120*b* are disposed on a base substrate such that the connectors 120*b* correspond to the first, second and third lamps 112, 114 and 116. The connectors 120*b* may be disposed adjacent to the first and second sides of the first, second, and third inverters 122, 124, and 126. The connectors 120*b* are electrically connected to lead lines 116 of the first, second and third lamps 112, 114 and 116 through connecting wirings 118 to apply the driving voltage to the first, second and third lamps 112, 114 and 116.

The lamp fixing unit (such as previously shown in FIG. 4) is disposed at end portions of the lamps 110 to fix the lamps 110. The lamp fixing unit may include fixing clips for fixing the end portions of the lamp 110.

Figure 10:
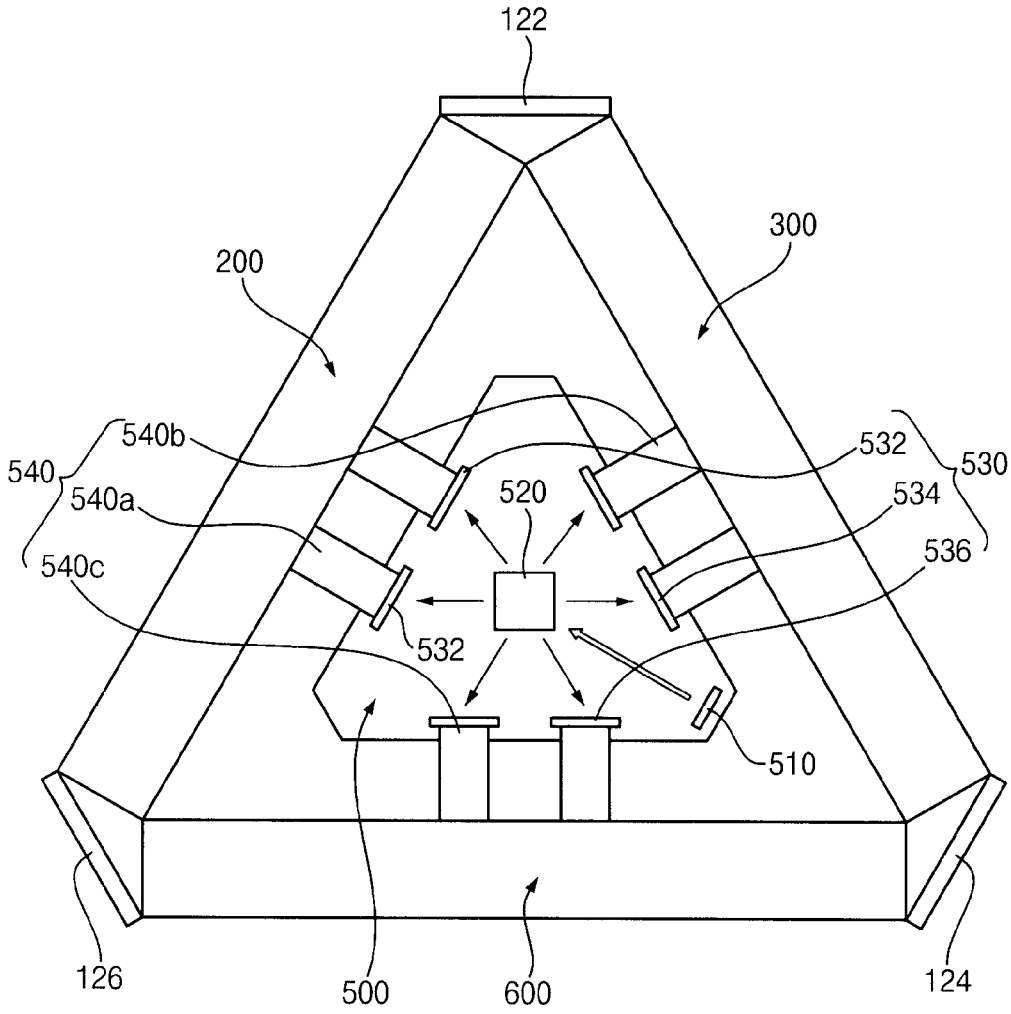
FIG. 10 is a plan view illustrating the exemplary display apparatus in FIG. 8.

FIG. 10 is a plan view illustrating the exemplary display apparatus in FIG. 8.

Referring to FIGS. 8 and 10, the control board 500 is disposed at an upper portion of the backlight assembly 100'. In detail, the control board 500 is disposed in a triangular region defined by the first top chassis of the first display panel assembly 200, the second top chassis of the second display panel assembly 300 and the third top chassis of the third display panel assembly 600.

The control board 500 includes an input connector 510, a timing controller 520 and an output connector 530.

The input connector 510 receives an image signal from an external graphic controller (not shown).

The timing controller 520 is electrically connected to the input connector 510 to receive the image signal, and generates driving signals in response to the image signal.

The output connector 530 is electrically connected to the timing controller 520 to receive the driving signals. For example, the output connector 530 is electrically connected to the first, second and third display panel assemblies 200, 300 and 600 through an FPCB 540 to transfer the driving signals to the first, second and third display panel assemblies 200, 300 and 600.

In detail, the output connector 530 includes a first output section 532 electrically connected to the first display panel assembly 200 through a first FPCB 540*a*, a second output section 534 electrically connected to the second display panel assembly 300 through a second FPCB 540*b*, and a third output section 536 electrically connected to the third display panel assembly 600 through a third FPCB 540*c*. Each of the first, second, and third output sections 532, 534, and 536 may include one or more output sections respectively connected to the first, second, and third display panel assemblies 200, 300, and 600 by one or more FPCBs 540.

As a result, the display apparatus including the control board 500 in FIG. 10 displays an image in three directions through the first, second and third display panel assemblies 200, 300 and 600.

Figure 11:
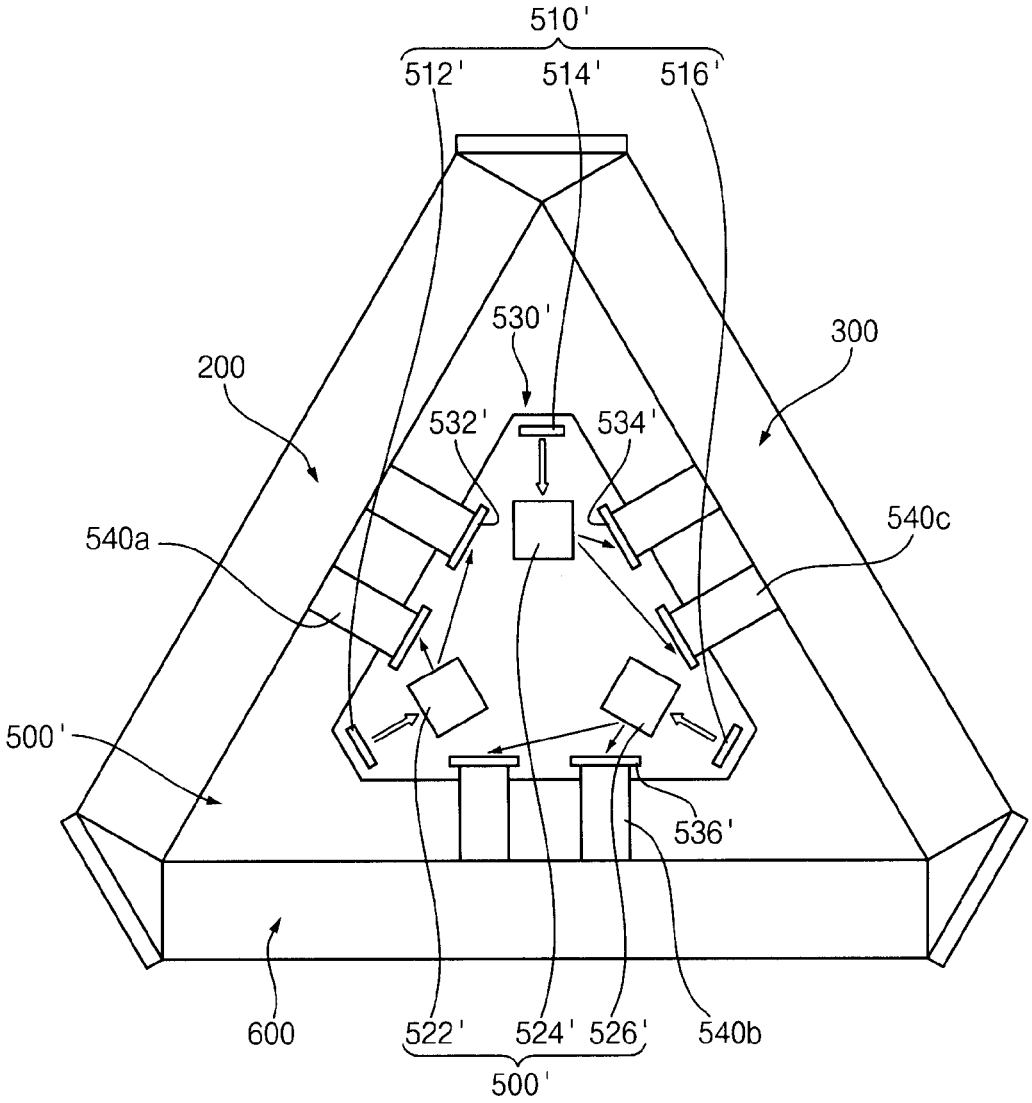
FIG. 11 is a plan view illustrating an exemplary display apparatus different from the exemplary display apparatus in FIG. 10.

FIG. 11 is a plan view illustrating an exemplary display apparatus different from the exemplary display apparatus in FIG. 10.

Referring to FIG. 11, the control board 500' may have a different structure from the control board 500 in FIG. 10 for displaying different images through the first, second and third display panel assemblies 200, 300 and 600.

In detail, the control board 500' includes an input connector 510', a timing controller 520' and an output connector 530'.

The input connector 510' includes a first input section 512' receiving a first image signal from a first external device (not shown), a second input section 514' receiving a second image signal from a second external device (not shown) and a third input section 516' receiving a third image signal from a third external device (not shown).

The timing controller 520' includes a first control section 522' generating a first driving signal in response to the first image signal, a second control section 524' generating a second driving signal in response to the second image signal and a third control section 526' generating a third driving signal in response to the third image signal.

The output connector 530' includes a first output section 532' outputting the first driving signal to the first display panel assembly 200 via the first FPCB 540*a*, a second output section 534' outputting the second driving signal to the second display panel assembly 300 via the second FPCB 540*b*, and a third output section 536' outputting the third driving signal to the third display panel assembly 600 via the third FPCB 540*c*.

As described above, the control board 500' according to the present exemplary embodiment separately controls the first, second and third display panel assemblies 200, 300 and 600 through the first, second and third control sections 522', 524' and 526'. Therefore, the display apparatus employing the control board 500' may simultaneously display different images through the first, second and third display panel assemblies 200, 300 and 600.

According to the present embodiment described above, the backlight assembly 100' simultaneously provides the first, second and third display panel assemblies 200, 300 and 600 with light. As a result, costs for manufacturing the backlight assembly 100' may be reduced.

According to the present invention, a backlight assembly applies light to first and second display panel assemblies or first, second and third display panel assemblies to reduce the number of backlight assemblies. Therefore, costs for manufacturing a display apparatus, such as an outdoor display apparatus, may be reduced.

Having described the exemplary embodiments of the present invention and its advantages, it is noted that various changes, substitutions and alterations can be made herein without departing from the spirit and scope of the invention as defined by appended claims.

What is claimed is:

1. A display apparatus comprising:

a backlight assembly including first light sources emitting first light through a first face of the backlight assembly and second light sources emitting second light through a second face of the backlight assembly;

a first display panel assembly disposed adjacent to the first face to receive the first light; and a second display panel assembly disposed adjacent to the second face to receive the second light, wherein the first light sources are disposed adjacent to and more proximate to a first major surface plane defining the first display panel assembly than to a second major surface plane defining the second display panel assembly and the second light sources are disposed adjacent to and more proximate to a second major surface plane defining the second display panel assembly than to the first major surface plane defining the first display panel assembly, and wherein the backlight assembly is disposed directly between the first and second major surface planes defining the first and second display assemblies, respectively.

2. The display apparatus of claim 1, wherein the first light sources comprise a plurality of first lamps arranged substantially parallel with each other and the second light sources comprise a plurality of second lamps arranged substantially parallel with each other.

3. The display apparatus of claim 2, wherein the backlight assembly further comprises a driving inverter electrically connected to first and second ends of the first and second lamps to provide the lamps with driving voltages.

4. The display apparatus of claim 3, wherein the first and second lamps are alternately disposed with respect to each other to form a zigzag shape.

5. The display apparatus of claim 3, wherein the first and second lamps have a cylindrical shape along a first direction, and are arranged substantially parallel with each other along a second direction that is substantially perpendicular to the first direction.

6. The display apparatus of claim 5, wherein the driving inverter comprises:

a first inverter electrically connected to first ends of the first and second lamps; and a second inverter electrically connected to second ends of the first and second lamps.

7. The display apparatus of claim 6, wherein the first inverter is disposed at a first side of the backlight assembly; and the second inverter is disposed at a second side of the backlight assembly, the second side being opposite to the first side along the first direction.

8. The display apparatus of claim 1, further comprising:

a control board providing the first and second display panel assemblies with driving signals to control the first and second display panel assemblies.

9. The display apparatus of claim 8, wherein the lamps extend longitudinally along a first direction and are arranged with respect to each other along a second direction that is substantially perpendicular to the first direction, and the control board is disposed on a side of which normal axis is substantially parallel with the second direction.

10. The display apparatus of claim 8, wherein the control board comprises:

an input connector receiving an image signal from an external device;

a timing controller generating the driving signals in response to the image signal; and an output connector outputting the driving signals to the first and second display panel assemblies.

11. The display apparatus of claim 10, wherein the input connector comprises a first input section receiving a first image signal and a second input section receiving a second image signal, the timing controller comprises a first timing control section generating a first driving signal in response to the first image signal and a second timing control section generating a second driving signal in response to the second image signal, and the output connector comprises a first output section outputting the first driving signal to the first display panel assembly, and a second output section outputting the second driving signal to the second display panel assembly.

12. The display apparatus of claim 3, wherein the backlight assembly further comprises a lamp fixing unit disposed at end portions of the lamps to fix the lamps.

13. The display apparatus of claim 1, wherein the first display panel assembly comprises:

a first display panel disposed adjacent to the first face of the backlight assembly;

first optical sheets disposed between the first face of the backlight assembly and the first display panel;

a first mold frame receiving the first display panel and the first optical sheets; and a first top chassis fastening the first display panel to the first mold frame, and the second display panel assembly comprises:

a second display panel disposed adjacent to the second face of the backlight assembly;

second optical sheets disposed between the second face of the backlight assembly and the second display panel;

a second mold frame receiving the second display panel and the second optical sheets; and a second top chassis fastening the second display panel to the second mold frame.

* * * * *